US005605293A

United States Patent [19]

Imae et al.

[11] Patent Number: 5,605,293

[45] Date of Patent: Feb. 25, 1997

[54] METHOD FOR CONTROLLING SPINDLE-DRIVE TYPE YARN WINDER

[75] Inventors: Masazumi Imae, Moriyama; Naotaka Yamamoto, Koga-gun, both of Japan

[73] Assignee: Toray Engineering Co., Ltd., Osaka, Japan

[21] Appl. No.: 426,655

[22] Filed: Apr. 21, 1995

[30] Foreign Application Priority Data

Apr. 22, 1994 [JP] Japan ..... 6-107761

[51] Int. Cl.[6] ..... B65H 67/044

[52] U.S. Cl. ..... 242/18 A

[58] Field of Search ..... 242/18 A, 18 R, 242/25 A

[56] References Cited

FOREIGN PATENT DOCUMENTS 0128101 12/1984 European Pat. Off. .

0391101 10/1990 European Pat. Off. .

5-27404 4/1988 Japan .

5-155531 6/1993 Japan .

*Primary Examiner*—Michael R. Mansen

*Attorney, Agent, or Firm*—Burns, Doane, Swecker & Mathis, L.L.P.

[57] ABSTRACT

To equalize yarn tensions in a normal winding mode and a yarn switching mode when a yarn take-up operation is carried out by a yarn winder, the surface speed of the contact roller 4 or the frequency of current for driving the contact roller-driving motor 7 is controlled in a programmed manner. The programmed control is based on whether the winder is in the normal winding mode, the yarn switching mode in which the yarn is switched from a full bobbin to an empty bobbin, or a soft-touch winding mode in which the contact roller is brought into soft contact with the empty bobbin.

4 Claims, 2 Drawing Sheets

METHOD FOR CONTROLLING SPINDLE-DRIVE TYPE YARN WINDER

BACKGROUND OF THE INVENTION

1. Field of the Invention

The present invention relates to a method for controlling a spindle-drive type yarn winder.

2. Description of the Related Art

Recently, when a synthetic fiber yarn is continuously taken up at a high speed, a spindle-drive type yarn winder is used, comprising a turret member on which a plurality of spindles are rotatably mounted, a traversing mechanism held on a machine frame to be located upstream of one spindle which is in a yarn winding condition, a contact roller to be brought into press-contact at a predetermined pressure with a yarn layer wound on a bobbin carried on the spindle, induction motors for driving each one of the spindles, an induction motor for driving the contact roller, an inverter for controlling the rotational speed of each induction motor, and a controller for controlling the rotational speeds of each one of the spindles and the contact roller.

The yarn winder of the above-mentioned type is disclosed, for example, in Japanese Unexamined Utility Model Publication No. 5-27404, wherein the rotational speeds of the contact roller and the spindle in a normal winding mode are controlled in a different manner from that in a yarn switching mode by detecting the rotational speed of the contact roller, so that the circumferential speed is always constant by driving the contact roller at a predetermined rotational speed.

In such a method for controlling the surface speed of the contact roller at a constant value as stated above, there is a drawback in that yarn properties such as a stretch tension value, a thermal contraction stress value or the like in the innermost layer of a yarn package, which is formed in the yarn switching mode, deteriorate compared to those in the intermediate layer of a yarn package, which is formed in the normal winding mode.

It is surmised that the above change of yarn quality is caused by the actual increase of yarn tension in the yarn switching mode.

SUMMARY OF THE INVENTION

An object of the present invention is to obtain a package having a uniform yarn quality throughout the package by maintaining the actual winding tension at a substantially constant value, during a yarn winding operation and a yarn switching operation.

To solve the above problems, according to the present invention, a method for controlling a spindle-drive type yarn winder in a yarn take-up operation is provided, characterized in that at least one of the surface speed of the contact roller and the driving frequency for driving the contact roller-driving induction motor is controlled in a programmed manner when a normal winding operation, a yarn switching operation from a full bobbin to an empty bobbin and a soft-touch or non-touch winding operation is carried out.

Also, the surface speed of the contact roller or the driving frequency for driving the contact roller-driving induction motor is controlled in a feedback manner based on the rotational speed of the contact roller.

DETAILED DESCRIPTION OF THE PREFERRED EMBODIMENT

Figure 1:
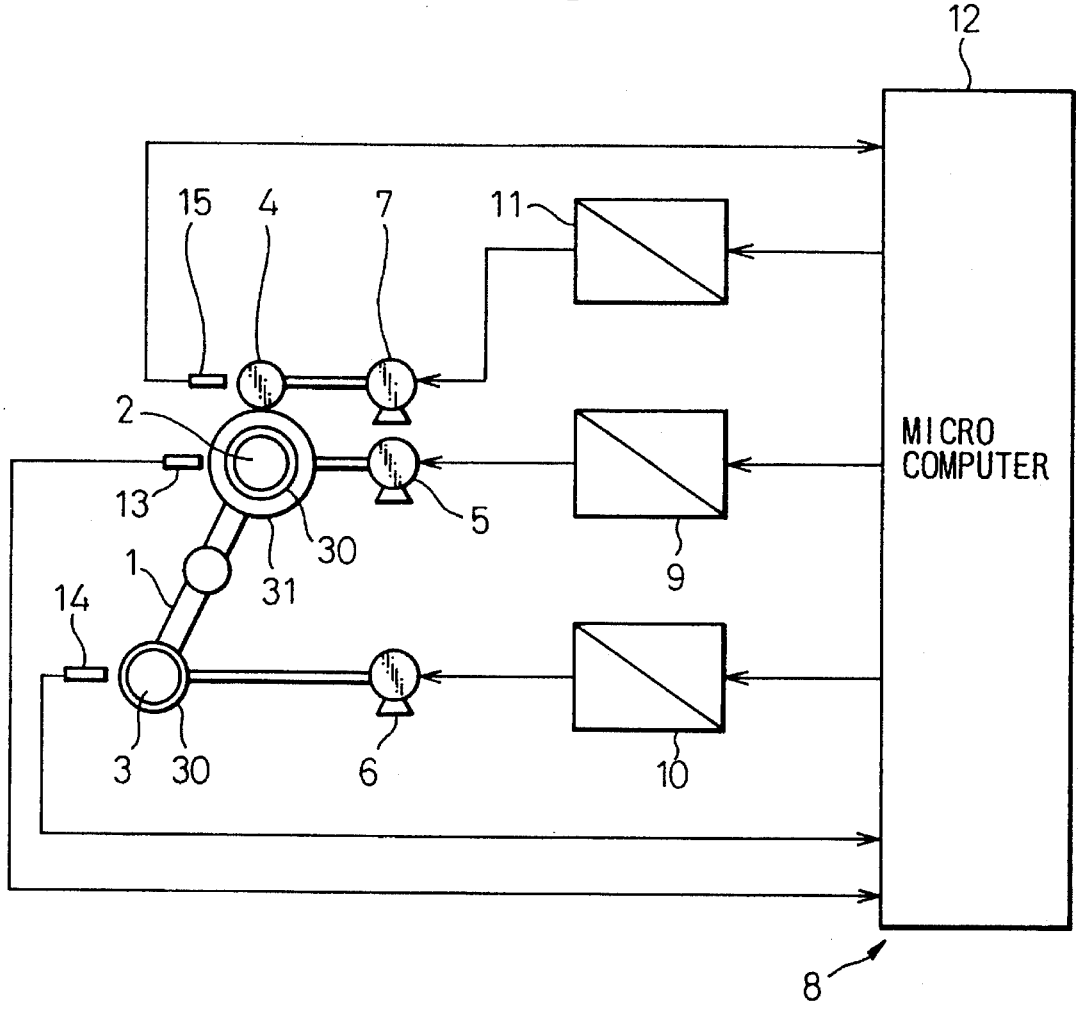
FIG. 1 is a schematic illustration of a system used to perform a method for controlling a spindle-drive type yarn winder according to the present invention.

FIG. 1 illustrates an arrangement for carrying out a method for controlling a spindle-drive type yarn winder according to the present invention, wherein a yarn winder includes bobbin-carrying spindles 2, 3, rotatably held on a turret member 1 which in turn is supported on a frame (not shown); a contact roller 4 brought into contact at a predetermined pressure with a bobbin 30 carried by one of the spindles 2 or 3; a yarn traverse mechanism (not shown); induction motors 5, 6 for rotating the spindles 2, 3, respectively; an induction motor 7 for rotating the contact roller 4; a driving mechanism (not shown) for rotating the turret member 1; and a controller 8 for controlling the rotational speeds of the respective induction motors 5, 6 and 7.

The controller 8 includes inverters 9, 10 and 11; a microcomputer 12 with an inputting function, a memory function, a comparator function, a command function or others; a sensor 13 for detecting the rotational speed of either of the spindles 2 or 3 located at a winding position and transmitting a detection signal to the microcomputer 12; a sensor 14 for detecting the rotational speed of either of the spindles 2 or 3 located at a waiting position and transmitting a detection signal to the microcomputer 12; and a sensor 15 for detecting the rotational speed of the contact roller 4 and transmitting a detection signal to the microcomputer 12.

As an alternative to the above microcomputer 12, a programmable logic controller (PLC) may be used.

Also, the sensors 13, 14 and 15 may be of a photoelectric type, an electromagnetic type or an electrostatic capacitance type.

A program-control method will be described below with reference to a schematic diagram illustrated in FIG. 2, which shows the variation of the surface speeds of a spindle and contact roller throughout the yarn winding operation, including the yarn switching mode, carried out by the above spindle-drive type yarn winder.

The explanation of the control method will begin from midway in the normal winding mode.

Figure 2:
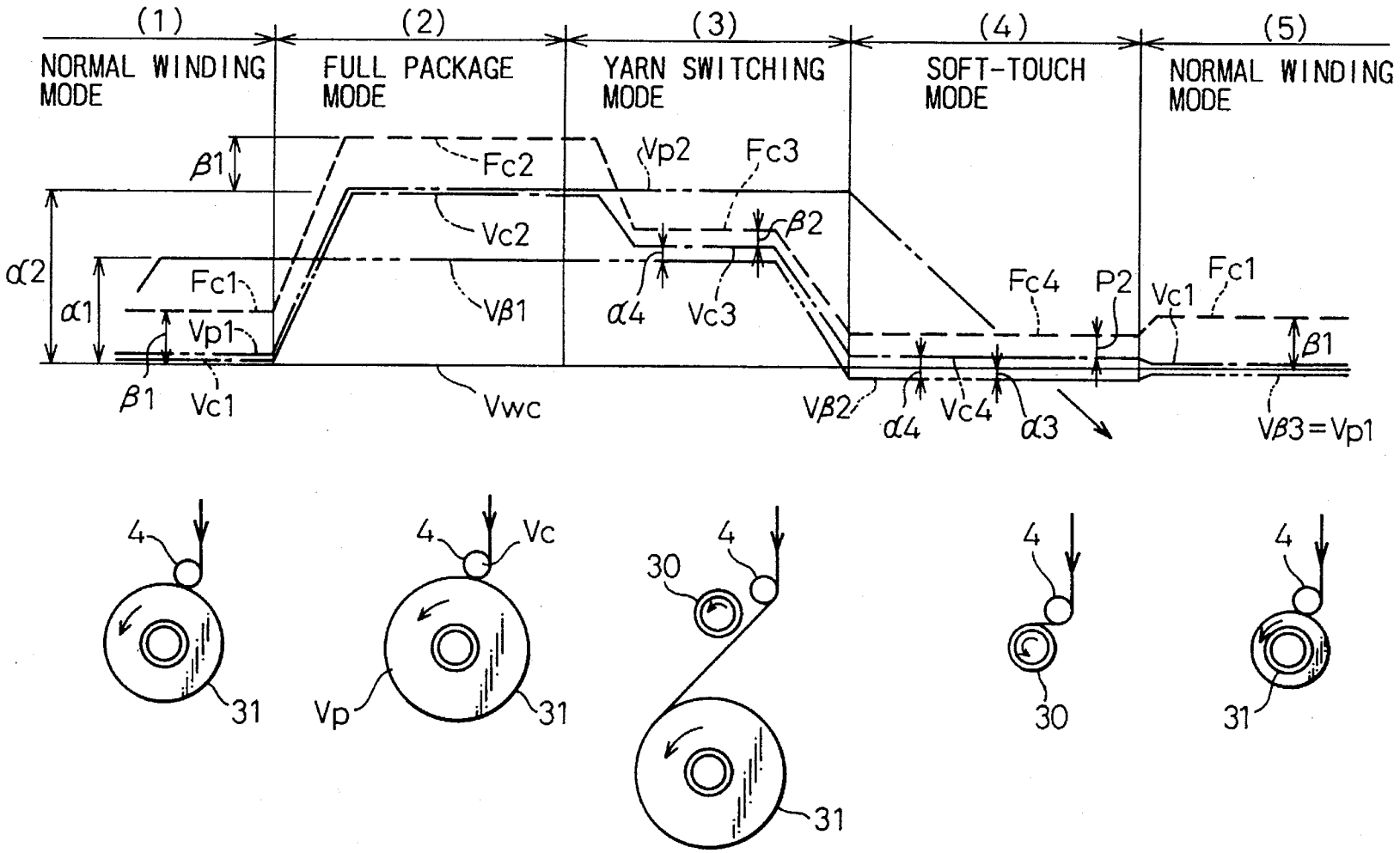
FIG. 2 is a schematic diagram for illustrating the variation of surface speeds of the spindle and the contact roller throughout the yarn take-up operation including the yarn switching step, when the spindle-drive type yarn winder is controlled by the inventive method.

First, assuming that a predetermined yarn winding speed in the normal winding mode is $V_{WC}$ (m/min), a surface speed of a package 31 is $V_{P1}$ (m/min), and a surface speed of the contact roller 4 is $V_{C1}$ (m/min) in the normal winding mode as shown in FIG. 2(1), the surface speeds of the spindle 2 and the contact roller 4 are controlled, while using the predetermined winding speed $V_{WC}$ as a reference, so that the respective speeds satisfies the following equation.

$$V_{WC}=V_{P1}=V_{C1}$$

In the figure, the predetermined winding speed $V_{WC}$ is represented by a solid line; the surface speed $V_{C1}$ of the contact roller 4 by a one-dot chain line; and the surface speed $V_{P1}$ of the package 31 by a two-dot chain line. All of these lines are actually positioned on the same horizontal line, but are shown in the drawing slightly shifted from each other in the vertical direction for the purpose of explanation.

A driving frequency $F_{C1}$ (Hz) for driving the induction motor 7 to drive the contact roller 4 during yarn winding operation is determined by the following equation wherein K is a constant $(60\ \pi D)^{-1}$; D is a diameter (m) of the contact roller 4; and $\beta_1$ (%) is a slip correction factor of the contact roller 4, when it is brought into contact with the yarn package 31, and is controlled by the inverter 11 to be maintained at this value $[F_{C1}]$.

The frequency $F_{C1}$ is shown by a broken line at a position corresponding to the predetermined winding speed $V_{WC}$ added with the slip correction factor $\beta_1$.

$$F_{C1}=K(1+\beta_1/100)V_{C1}$$

The yarn take-up operation is conducted by driving the contact roller 4 based on the above-mentioned frequency $F_{C1}$. When the package 31 becomes almost full, the spindle 3 for an empty bobbin is driven by the induction motor 6 to start the rotation.

The surface speed $V_{B1}$ (m/min) of the empty bobbin 30 is determined by the following equation wherein $\alpha_1$ is a speed correction factor (%) when the spindle 3 for the empty bobbin is operated, and is shown by a three-dot chain line in FIG. 2(1) at a position corresponding to the predetermined winding speed $V_{WC}$ with the added correction factor $\alpha_1$.

$$V_{B1}=(1+\alpha_1/100)V_{WC}$$

An explanation of the frequency of current for driving the induction motor 5 for the spindle 2 is omitted.

Next, when a predetermined amount of yarn has been taken up, as shown in FIG. 2(2), the induction motor 5 for driving the spindle 2 and the induction motor 7 for driving the contact roller 4 are accelerated.

The surface speed $V_{P2}$ (m/min) of the package 31 is determined by the following equation wherein $\alpha_2$ is a speed correction factor (%) of the spindle when the bobbin is full.

$$V_{P2}=(1+\alpha_2/100)V_{WC}$$

The surface speed $V_{P2}$ (m/min) of the package 31 and the surface speed $V_{C2}$ (m/min) of the contact roller 4 are controlled to be equal to each other, i.e., $[V_{P2}]=[V_{C2}]$.

An one dot chain line representing surface speeds $V_{C2}$ of the contact roller 4 and a two dot chain dot line representing surface speed $V_{P2}$ are actually positioned on the same line in the drawing, but are shown as if they were slightly shifted from each other in the vertical direction for the purpose of explanation.

The induction motor 7 is regulated by controlling the frequency $F_{C2}$ (Hz) of the current for driving the same to be a value determined by the following equation.

$$F_{C2}=K(1+\beta_1/100)V_{C2}$$

When the above-mentioned package 31 has become full, the turret member 1 rotates to bring the package 31 to a waiting position and the empty bobbin 30 to a winding position as shown in FIG. 2(3). Then a yarn switching mechanism (not shown) operates to shift the yarn from the full package 31 to the empty bobbin 30.

At this time, the contact roller 4 is driven at a position wherein the contact roller 4 is in a soft-touch winding state relative to the empty bobbin 30 while being decelerated from the surface speed $V_{C2}$ (m/min) in a full package mode to a surface speed $V_{C3}$ (m/min) in a yarn switching mode.

The soft-touch winding state is one wherein the contact roller 4 comes into contact with the empty bobbin 30 at a pressure lower than that in the normal winding mode.

The surface speed $V_{C3}$ (m/min) of the contact roller 4 is determined by the following equation while using the same speed correction factor $\alpha_4$ (%) as that of the contact roller 4 in the soft-touch winding mode.

$$V_{C3}=(1+\alpha_4/100)V_{B1}$$

The induction motor 7 is controlled so that the driving frequency $F_{C3}$ (Hz) for driving the motor to be a value determined by the following equation, utilizing a slip correction factor identical to that of the slip correction factor $\beta_2$ of the contact roller 4 during the soft winding operation is carried out.

$$F_{C3}=K(1+\beta_2/100)V_{C3}$$

When the yarn is initially wound on the empty bobbin 30, the empty bobbin 30 carried on the spindle 3 is decelerated from the surface speed $V_{B1}$ (m/min) in the normal winding mode to the surface speed $V_{B2}$ (m/min) in the soft-touch winding mode, and the contact roller 4 is also decelerated from the surface speed $V_{C3}$ (m/min) in the yarn-switching mode to the surface speed $V_{C4}$ (m/min) in the soft-touch winding mode as shown in FIG. 2(4).

The surface speed $V_{B2}$ (m/min) of the empty bobbin 30 is determined by the following equation wherein 3 is a speed correction factor (%) for the spindle 3 in the soft-touch winding mode, and the surface speed $V_{B2}$ of the bobbin 30 is lower by $\alpha_3$% than the predetermined winding speed $V_{WC}$. Accordingly, this speed $V_{B2}$ of the empty bobbin 30 is shown in the drawing at a position beneath the position of the predetermined winding speed $V_{WC}$ shown by a solid line.

$$V_{B2}=(1-\alpha_3/100)V_{WC}$$

The surface speed $V_{C4}$ (m/min) of the contact roller 4 at this stage is determined by the following equation.

$$V_{C4}=(1+\alpha_4/100)V_{B2}$$

The driving frequency $F_{C4}$ (Hz) for driving the induction motor 7 for the contact roller 4 is determined at this instant by the following equation.

$$F_{C4}=K(1+\beta_2/100)V_{C4}$$

On the other hand, the spindle 2 carrying the full bobbin located at the waiting position is decelerated and stopped.

When a predetermined amount of yarn is taken up in the soft-touch winding mode, as described above and the yarn layer on the bobbin 30 as shown in FIG. 2(5) is brought into contact with the contact roller 4, the surface speed of the empty bobbin 30 is switched from $V_{B2}$ (m/min) in the soft-touch winding mode to $V_{B3}$ (m/min) in the normal winding mode so that the yarn take-up operation is carried out under the same conditions as in the case shown in FIG. 2(1).

The surface speed $V_{B3}$ in the normal winding mode is equal to $V_{P1}$ in FIG. 2(1).

Alternatively, when the yarn is newly threaded onto the empty bobbin 30, the surface speeds of the empty bobbin 30 and the contact roller 4 are controlled so that the conditions thereof are equal to those in the yarn switching mode shown in FIG. 2(3).

The speed correction factor $\alpha_1$ of the spindle 3 carrying the empty bobbin in the yarn switching or threading mode may be within a range between 0% and 5%, preferably between 0.5% and 2.0%, in accordance with kinds or thickness of yarns, etc.

Preferably, a smaller value of the speed correction factor $\alpha_1$ is selected when the yarn is thinner, while a larger value is selected when the yarn is thicker, so that the yarn can be prevented from slacking and being wound around the roller.

If a speed correction factor out of the above range is selected, the yarn switching operation from the full bobbin to the empty bobbin may be impossible since the tension variation becomes so large that it may cause yarn breakage.

Also, the speed correction factor $\alpha_2$ of the spindle when the bobbin is full may be selected within a range between 0% and 5%, but should preferably be selected within a range between 0.5% and 2.0% for facilitating the yarn switching operation without damaging the yarn quality.

The speed correction factor $\alpha_3$ of the spindle 3 in the soft-touch winding mode may be selected in a trial-and-error manner within a range between –0.5% and 1% with reference to kinds, thickness or take-up speeds of yarns.

The speed correction factor $\alpha_4$ (%) of the contact roller in the soft-touch winding mode may be selected, similar to $\alpha_3$, in a trial-and-error manner within a range between –0.5% and 1% with reference to kinds, thickness or take-up speeds of yarns.

Magnitudes of these correction factors of the spindle and the contact roller may be reversed when the yarn has a large contraction factor.

The slip correction factor $\beta_1$ (%) of the contact roller 4 in the normal winding mode mainly relies on a slip characteristic of the induction motor although it varies in accordance with the take-up speed, load-sharing ratio or the like, and may be selected within a range between 0.5% and 4%.

The slip correction factor $B_2$ of the contact roller 4 in the soft-touch winding mode must be smaller than 3 to 4% of a rating slip of the induction motor, and selected within a range between 0.5% and 3%.

The surface speed $V_{C4}$ of the contact roller 4 in the soft-touch winding mode may be controlled in an open-loop manner, but preferably in a feedback manner based on the surface speed of the contact roller 4 detected by the sensor 15 so that a package of favorable appearance is obtainable as a result of high accuracy control.

The same effect is obtainable as that of the soft-touch winding mode when the contact roller is not brought into soft contact with the empty bobbin but completely apart by a predetermined gap from the empty bobbin.

According to the method for controlling the spindle-drive type yarn winder, at least one of the surface speed of the contact roller and the frequency of current for driving the contact roller-driving induction motor is controlled in a programmed manner in accordance with the normal winding mode, the yarn switching mode from a full bobbin to an empty bobbin, and the soft-touch or non-touch winding mode. Therefore, it is possible to substantially equalize the yarn winding tension in the normal winding mode and that in the yarn switching mode to each other, whereby the success rate of yarn switching operation is enhanced and a package of good yarn quality is obtainable.

We claim:

1. A method for taking up yarn in a yarn winder that includes a turret member which is rotatably mounted on a machine frame for rotation about an axis of rotation, a pair of spindles rotatably mounted on the turret member for removably mounting bobbins, a contact roller urgable into contacting relation with a bobbin on one of the spindles, and a traversing mechanism held on the machine frame so as to be located upstream of one of the spindles positioned in a yarn winding condition, the method comprising the steps of:

winding yarn on the bobbin on one of the spindles through rotation of said one spindle and the contact roller while the contact roller is under a press-contact condition at a predetermined pressure with a yarn layer wound on the bobbin on said one spindle and while the yarn is traversed by the traversing mechanism so that a package of yarn is formed on the bobbin on said one spindle;

switching winding of the yarn from the bobbin on said one spindle to an empty bobbin on the other spindle when a full package condition is obtained on the bobbin on said one spindle by rotating the turret member about said axis of rotation, said switching step being followed by keeping a soft-touch or non-touch condition of the contact roller with respect to the bobbin on said other spindle while yarn is wound on the bobbin on the other spindle just after the commencement of the winding of the yarn on the empty bobbin;

controlling the peripheral speed of the contact roller through a programmed control during the switching step and the soft-touch or non-touch condition; and winding yarn on the bobbin on said other spindle through the press-contact condition of the contact roller with the yarn on the bobbin on said other spindle, the programmed control of the peripheral speed of the contact roller including obtaining a first predetermined value of the peripheral speed of the contact roller just before commencement of the movement of the turret member, obtaining a second predetermined value of the peripheral speed of the contact roller during movement of the turret member, and obtaining a third predetermined value of the peripheral speed of the contact roller during the soft-touch or non-touch winding condition.

2. A method according to claim 1, wherein each of said steps of obtaining first, second and third predetermined values of the peripheral speed of the contact roller comprise measuring a parameter of the peripheral speed of the contact roller, and feedback controlling the measured parameter to a predetermined value of the parameter which corresponds to the predetermined peripheral speed of the contact roller.

3. A method for taking up yarn in a yarn winder that includes a turret member which is rotatably mounted on a machine frame for rotation about an axis of rotation, a pair of spindles rotatably mounted on the turret member for removably mounting bobbins, a contact roller urgable into contacting relation with a bobbin on one of the spindles, a traversing mechanism held on the machine frame so as to be located upstream of one spindle positioned in a yarn winding condition, the method comprising the steps of:

winding yarn on the bobbin on one of the spindles by rotating said one spindle and the contact roller while the contact roller is under a press-contact condition at a predetermined pressure with a yarn layer wound on the bobbin on said one spindle and while the yarn is traversed on the bobbin on said one spindle to form a package of yarn on the bobbin on said one spindle;

switching winding of the yarn from said bobbin on said one spindle to an empty bobbin on the other spindle when a full package condition is obtained on said bobbin on said one spindle by rotating the turret member about said axis of rotation, said switching step being followed by keeping a soft-touch or non-touch condition of the contact roller with respect to the bobbin on said other spindle while yarn is wound on the bobbin on the other spindle;

controlling the peripheral speed of the contact roller by operating the contact roller under a first peripheral speed just before commencement of movement of the turret member, operating the contact roller under a second peripheral speed different from the first peripheral speed during movement of the turret member, and operating the contact roller under a third peripheral speed different from the second peripheral speed during the soft-touch or non-much condition; and commencing a winding of the yarn on the bobbin on said other spindle through the press-contact condition of the contact roller with the yarn on the bobbin on said other spindle.

4. A method according to claim 3, wherein said step of controlling the peripheral speed of the contact roller includes operating the contact roller under the second peripheral speed which is less than the first peripheral speed, and operating the contact roller under the third peripheral speed which is less than said first and second peripheral speeds.

* * * * *